United States Patent [19]

Barth et al.

[11] 4,276,705

[45] Jul. 7, 1981

[54] GRAPHICAL DISPLAY MEANS

[76] Inventors: William L. Barth, 1338 W. Vesta, Ontario, Calif. 91762; Clifford E. Barth, 16633 Arrow Pines, Azusa, Calif. 91702

[21] Appl. No.: 151,810

[22] Filed: May 21, 1980

Related U.S. Application Data

[63] Continuation-in-part of Ser. No. 955,959, Oct. 30, 1978, abandoned.

[51] Int. Cl.[3] ..... G09F 13/18

[52] U.S. Cl. ..... 40/579; 40/547

[58] Field of Search ..... 40/547, 579, 580, 603, 40/569, 546; 35/40, 42; 46/16, 17

[56] References Cited

U.S. PATENT DOCUMENTS

| | | | |
|---|---|---|---|
| 2,051,288 | 8/1936 | Curtis | 40/579 |
| 3,131,496 | 5/1964 | Schropp | 40/547 |
| 3,530,615 | 9/1970 | Meyer | 40/547 X |
| 3,568,357 | 3/1971 | Lebensfeld | 40/579 |
| 3,758,972 | 9/1973 | Egermayer | 40/603 |

*Primary Examiner*—John F. Pitrelli
*Attorney, Agent, or Firm*—John H. Crowe

[57] ABSTRACT

A graphical display apparatus having an enclosure with a thin opaque cover made up of an outermost sheet of paper bearing a design, to serve as a display face, and an underlying sheet of aluminum foil backed by an aluminum screen. Incandescent lights are mounted within the enclosure to light its interior. Through the use of pointed markers made of transparent plastic, pinpoints of light can be spotted where desired on the display face for any of various purposes. This is accomplished by pushing the markers through the display face, aluminum foil and aluminum screen at desired locations. The markers are exposed to light in the interior of the enclosure as they pierce the aluminum foil, and therefore show up as points of light on the display face. The incandescent lights in the enclosure emit heat, as a result of which the layer of aluminum foil reacts to bring about a tightening and smoothing of the display face. The aluminum screen holds the markers in position after they are pushed through the cover of the enclosure to position them on the display face.

6 Claims, 4 Drawing Figures

GRAPHICAL DISPLAY MEANS

CROSS-REFERENCE TO RELATED APPLICATION

This application is a continuation-in-part of our copending U.S. Application Ser. No. 955,959, filed Oct. 30, 1978, now abandoned.

BACKGROUND OF THE INVENTION

This invention relates generally to lighted graphical display means, and more particularly to such means permitting the formation of random light patterns, for the conveyance of information, on a thin opaque cover for a light chamber by the controlled leakage of light through the cover at predetermined locations thereon.

It has long been customary to display information on maps, graphs, scheduling boards, and the like, through the use of color-coded pins and similar markers. In other cases, illuminated markers have been employed for such purposes. U.S. Pat. No. 3,131,496 to Schropp involves such display means, and relates to luminous display boards or panels on which information is conveyed by differences in luminosity and/or color between adjacent portions thereof. One of Schropp's embodiments includes a facing sheet mounted on a board which is in turn mounted on a relatively thick backing layer of resilient material. This composite panel structure covers a light chamber, and transparent or translucent "sign rods" can be forced through it so as to extend into the light chamber and appear as illuminated dots on the facing sheet. Other rods can be employed as "blind" rods, and these are forced only part way through the resilient backing layer of the panel structure so as to remain where positioned without penetrating to the light chamber. The purpose of the blind rods is to confuse those unfamiliar with the manner in which the display board functions as to the information it conveys, because there is no way of distinguishing the blind rods from those rods conveying meaningful information when the light is turned off in the light chamber.

In addition to the Schropp patent, various other patents show the use of transparent markers in such a way as to convey light through rigid light chamber covers for various purposes. For example, U.S. Pat. No. 3,568,357 to Lebensfeld discloses a game apparatus having a rigid cover for a light chamber consisting of a peg board backed by a punctured lining pad formed of a plastic or rubber material through which transparent markets are thrust for game playing purposes. U.S. Pat. No. 3,530,615 to Meyer discloses a toy for creating illuminated designs in which the front cover for a housing with a light inside is formed from a pair of perforated plates and an intermediate grid, along with a sheet of opaque material such as black construction paper or drawing paper, which is inserted between the grid and the front perforated plate.

There are many CB radio operators throughout the world who take great pride in communicating with one another and keeping track of the locations of the various stations they have been in contact with. Such operators often use a map, for example a map of the United States, for this purpose, and employ colored pins, or the like, to mark the locations of the CB stations they have contacted. Such maps are frequently mounted on some type of board and hung on the walls of CB operators' stations. While it would be desirable to provide such a map with lighted markers because of their unique visual effectiveness and decorative potential, no such thing has been heretofore proposed to our knowledge. None of the illuminated display face assemblies disclosed in the above-mentioned patents would be suitable for use as such a wall map because it would be too bulky, cumbersome and heavy for the purpose, particularly when it is considered that many CB operators are women and children who would have difficulty even lifting the map, much less mounting it on a wall.

SUMMARY OF THE INVENTION

We have now provided, in the graphical display means of this invention, a lightweight frame defining a relatively flat or shallow light chamber and carrying a map or the like on its cover or face to which lighted indicia conveying desired information can be randomly affixed. The map, preferably made of paper, is fastened flush against the cover of the light chamber, which cover is thin and flexible, comprising, in its preferred form, a single layer of aluminum foil over an aluminum screen backing. The light chamber preferably has heat emitting light means, for example, a plurality of incandescent bulbs, mounted therein.

In the latter connection, above, we have discovered that the aluminum foil in the light chamber cover tends to expand slightly under the influence of heat from the light means, and thereby stretch the slack out of the overlying map and render it taut and wrinkle-free. We are not certain how this tightening and smoothing of the latter is brought about, but we have nevertheless observed that it takes place. It might be that the aluminum foil expands somewhat as it heats up and concurrently is pressurized by the air within the light chamber, also expanding as it heats up, so that the foil balloons slightly outwardly and takes up any slack in the overlying map or the like to smooth it out. As will be seen, the cover of the light chamber must be opaque to light, and aluminum foil, of course, possesses that feature.

Transparent or translucent markers having pointed shanks and enlarged heads, are employed to form illuminated indicia on the face of the apparatus. Such indicia can serve the purpose of conveying information, such as, for example, the locations of CB stations with whom a station operator has communicated. They can also be used to form decorative borders around map areas, or for other eye-catching purposes. The markers can be clear, or colored for information coding or purely decorative purposes. To affix a typical marker to the display face of the apparatus, its pointed shank is merely thrust as far as the marker head through the map or other display sheet, the underlying sheet of aluminum foil and the aluminum backing screen forming the cover of the light chamber. When the shank penetrates the foil, light from the interior of the light chamber is transmitted therethrough to illuminate the head of the marker. Our graphical display apparatus will normally be provided with switch means for turning the light, or lights, in the light chamber on and off. The aluminum screen behind the aluminum foil serves to retain the transparent markers in position when they are pushed through the foil as described, as well as to provide reinforcing support for the thin, flexible foil. Conventional aluminum window or door screening material is suitable for the purpose here, and markers made of transparent plastic in different colors with shanks sized to fit through the mesh openings of the screen are available from commercial suppliers of party materials and the like.

Our novel display apparatus typically has a light chamber of sufficiently limited volume to insure the above-described benefits of the heat from its light source on the aluminum foil. The display is, as indicated above, sufficiently flat for mounting on a wall and light enough in weight to permit this with little difficulty.

It is thus a principal object of the present invention to provide a lightweight display may assembly that can be easily hung on a wall and readily fitted with illuminated indicia as desired for information conveying or decorative purposes.

Another object of the invention is to provide such a display map assembly with a display face that automatically tightens itself into a smooth, slack-free surface when in use.

Other objects, features and advantages of the invention will become apparent in the light of subsequent disclosures herein.

DESCRIPTION OF THE PREFERRED EMBODIMENT

Figure 1:
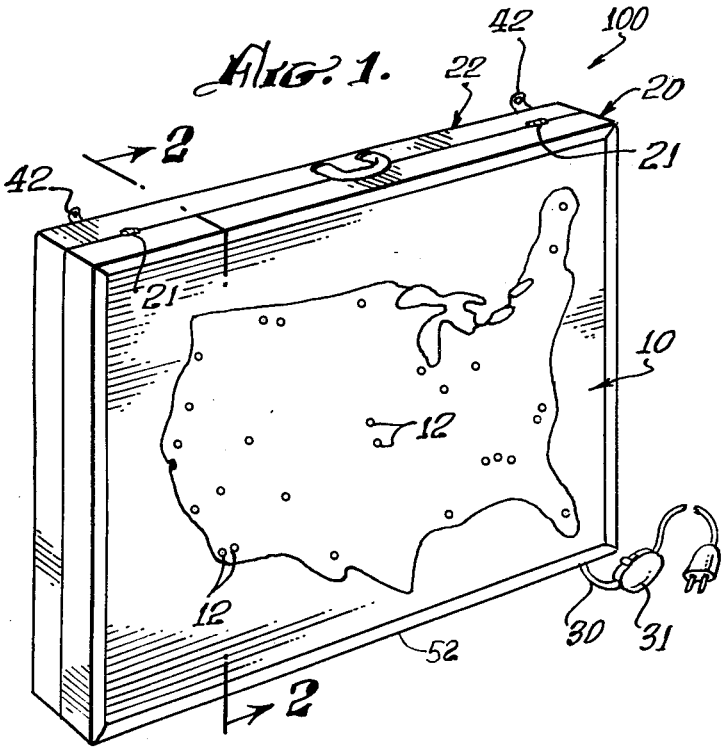
FIG. 1 is a perspective view of a preferred embodiment of a graphical display apparatus in accordance with this invention comprising an enclosed light box with a display face on which a map is mounted and showing a plurality of markers inserted through the map to provide pinpoints of light at specific locations thereon.

The perspective view of FIG. 1 shows a lighted display 100 featuring a map 10—as an illustrative example of a graphical presentation adapted for use in the display of the invention—mounted in the open face of a light box composed of a rear section 22 and frontal section 20. The front section 20 and rear section 22 of the light box are interconnected by suitable hardware in such a manner that light generated within the confines of the box can only escape through the face thereof. Such light may suitably be generated by known electrical means with current supplied through a cord 30, and controlled by a switch 31, typically a toggle switch.

Figure 2:
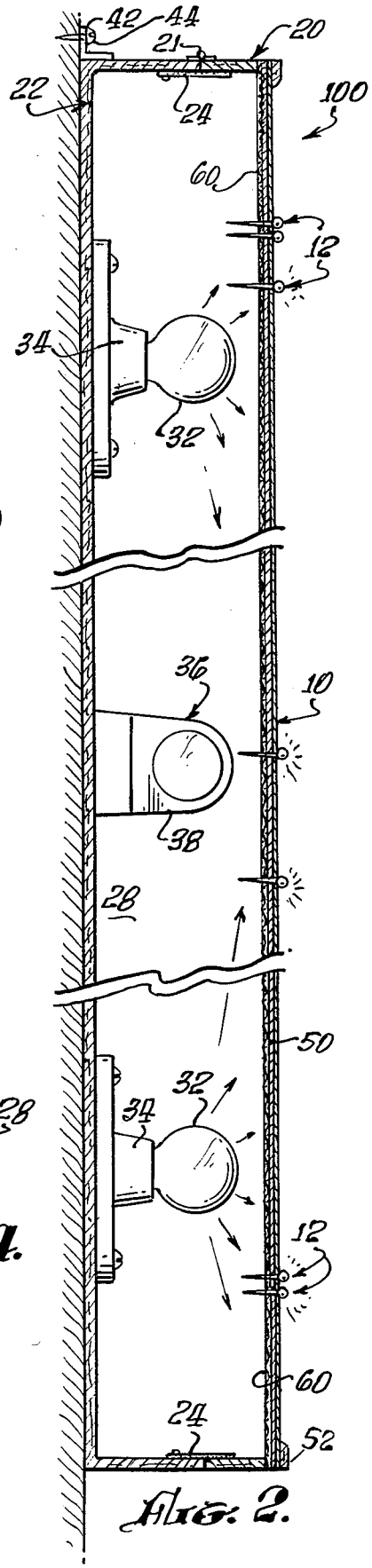
FIG. 2 is an enlarged, interrupted, cross-sectional view of the light box taken along line 2—2 of FIG. 1, but showing two alternative forms of light emitters therewithin as well as a plurality of lighted markers not present in FIG. 1 penetrating the display face.

The lighted display 100 is shown in transverse section in the view of FIG. 2, affixed to a wall 40 by means of lugs 42 and screws 44. The superposed inner and outer sections 22 and 20 of the light box are shown to be sealed at their joint seam by a light sealing strip 24. The two structural components of the light box are joined to one another by means of hinges 21 along their upper surfaces.

Within an internal volume 28 defined by the light box structure, a plurality of light sources, typically consisting of incandescent bulbs 32 socketed in fixtures 34 affixed to rear panel 26 of the inner light box section 22, are provided. In an alternative form of the lighting system fluorescent lights 36 held in brackets 38 may be provided as shown in the central segment of the FIG. 2 view.

The face of the light box is closed off by a laminar assembly comprising, from the outside in, the map 10, a backing sheet 50 of heavy duty aluminum foil and a tightly stretched aluminum screen 60. The aluminum foil sheet 50 is opaque and can be readily pierced by light transmitting markers such as shown at 12. The aluminum screen 60 acts as a structural stiffener and support for the facing sheet 10 and the aluminum foil sheet 50. The mesh openings of the screen are sized to permit ready passage of the markers 12 therethrough.

Figure 3:
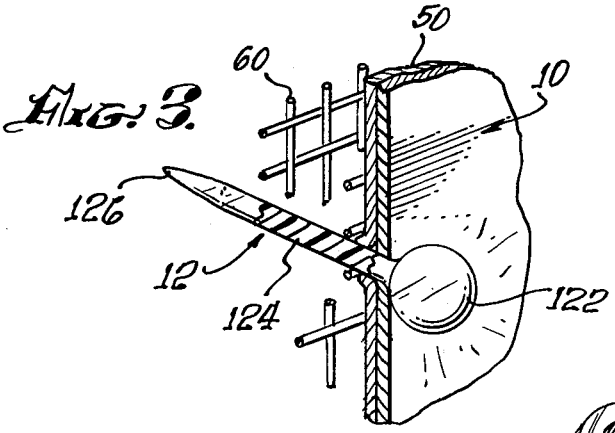
FIG. 3 is a still further enlarged, fragmentary, perspective view showing, in detail, the structure of the face of the light box with a lighted marker in penetrating relationship therewith.

FIG. 3 illustrates in greater detail than FIG. 2 the piercing relationship of a marker 12 with the face of the light box composed of facing sheet 10, aluminum foil sheet 50 and the aluminum screen 60. Our invention, incidentally, is not limited to the use of a single sheet of aluminum foil, and more than one such sheet can be employed, if desired. A single sheet has been found to be entirely satisfactory, however, for our purpose. Likewise, our invention is not necessarily limited to the use of aluminum foil, and any other metal foil having adequate properties for the purpose can be used in lieu thereof, or in combination therewith, if desired. The required properties include adequate strength and toughness for use as described without undue tearing, splitting, etc., and sufficient softness to permit easy penetration thereof by the light transmitting markers.

The display face assembly—including the facing sheet 10 with the graphic information impressed upon it, the aluminum foil backing sheet 50, and the aluminum wire mesh screen 60—is pierced, at the desired locations, by marker pins 12 constructed with a substantially cylindrical shank 124, a tapered piercing tip 126 and a spherical, light-radiating head 122. The diameter of the head 122 is substantially larger than the shank cross-section so that, upon the insertion of the marker into the display face assembly, the head may be pressed against the surface of the map 10 and remain in position. As indicated previously, the aluminum screen 60 helps to hold such markers in position and to support them in such fashion as to minimize the possibility of damage to the foil thereby. Without the screen, the foil might have a tendency to sag or tear when markers are pushed through it, particularly where such markers are positioned in close proximity to one another. With the screen present, however, markers can be positioned as close as possible on the map with substantially no risk of such damage to the foil, at least in part because of the reinforcing and supporting presence of the aluminum screen.

The marker 12 is constructed from a light transmitting material, such as glass or one of the transparent or transluscent plastics. Materials marketed under the names Lucite and Perspex are particularly suitable due to their known affinities for conveying light along a longitudinal axis with minimal loss in intensity. The head 122 may be tinted—so as to broaden the information content disseminated by the presence of a plurality of pins—or the entire pin 12 may be so colored, with a slight reduction in the light transmitted through the stem 124.

The light emitted from the marker heads 122 is derived from the sources mounted within the light box, either in the form of incandescent bulbs 32 or as fluorescent radiators 36. Incandescent bulbs are the preferred light source, because they emit a fairly substantial amount of heat and the presence of heat is, as previously indicated, highly desirable in our display apparatus in order to cause the aluminum foil to tighten and smooth the facing sheet overlying the foil. Fluorescent lights can be employed for our purpose, but since they emit less heat, relatively speaking, than incandescent bulbs, the stretching and tightening effect on the aluminum foil is slower than that of the bulbs.

The number and positioning of light units within the light box requires no special skill or knowledge, and can be determined with little difficulty for any particular box size and/or design. To give some idea of what the lighting demands might be for a light box of fairly typical size, we have constructed such a box for display of a map of the United States having face dimensions of 24 inches by 36 inches and a depth, or thickness, of approximately 6 inches. For this box, we found, after a minimum amount of experimentation, that three 25 Watt incandescent light bulbs produced optimum results insofar as its light and heat demands are concerned. It is readily apparent that the light conveyed along the stem of lighted markers 12 is sufficient to create a large degree of visual contrast between the face of map sheet 10 and the marker head 122, as long as a reasonable level of light intensity is maintained within the light box 20.

Figure 4:
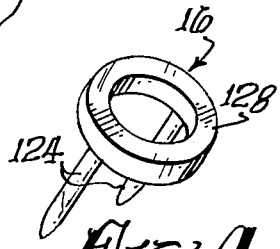
FIG. 4 is a perspective view of an alternative form of marker pin.

The markers of this invention need not be confined to those with spherical heads, and the heads can be of hemispherical, or other, form, as desired. The marker heads can also be supported on a plurality of light transmitting shanks within the scope of our invention. Exemplary of the latter is the marker embodiment shown in FIG. 4, which illustrates a marker pin 16 with a toroidal head 128 from which a pair of parallel shanks 124 extend. Such markers may be made with various symbols, shapes, bars and other geometrical forms to define information for the beholder of the display. In particular, markers may be made with such symbols as the letters of the alphabet, numerical signs and others, so as to enable a user to construct a graphical display relying entirely, or almost entirely, on message content defined by the shape and positioning of such markers alone.

In addition to the above-noted advantages of our novel graphical display apparatus (lightness of weight for easy handling, mounting on a wall, etc.; ease of marker pin emplacement thereon; reliability and serviceability in use even where marker pins are placed as closely as possible thereon; effectiveness of its flexible front cover in preventing light leakage except through penetrating marker pins; and the remarkable self tightening and smoothing capability of its display face in use), the apparatus has the added advantage of lending itself to quick and easy replacement of its display face sheet with another. Preferably this sheet is fastened over the aluminum foil backing sheet by means of molding strips around its edge, as shown at 52 on FIGS. 1 and 2 of the drawing.

While the novel graphical display apparatus of this invention has been herein illustrated and described in what we presently consider to be its preferred embodiment, it will be appreciated that various modifications thereof are possible within the scope of the invention. Some of these modifications have already been mentioned, and others will occur to those skilled in the art in art in the light of present teachings. Finally, it goes without saying that the scope of the present invention extends to all variant forms thereof encompassed by the language of the following claims.

We claim:

1. An internally-lighted display apparatus comprising:

enclosed housing means having an illumination source therein;

a relatively thin, laminar graphic display assembly forming a front cover for the housing means comprising a flexible outer layer of a metal foil impervious to light and a metal screen underlying said outer layer;

a plurality of light transmitting markers of clear plastic construction, each having a shank with a piercing tip at one end and an enlarged head at the opposite end;

said outer layer being a type of metal foil readily pierceable by light transmitting markers with pointed shanks through which light from the interior of said housing can be transmitted, and said metal screen being of suitable mesh size to receive the shanks of said markers and help hold the latter in place when they are positioned in penetrating relationship therewith;

and an outermost sheet, adapted to bear a design and readily penetrable by said markers, fastened in overlying relationship against said outer layer of metal foil as a display face for said apparatus; said illumination source is of a heat emitting character and said metal foil is of a type to stretch and tighten said outermost sheet under the influence of heat from said illumination source.

2. An internally-lighted display apparatus in accordance with claim 1 in which said metal foil is aluminum foil and said metal screen is aluminum screen.

3. An internally-lighted display apparatus in accordance with claim 2 in which said heat emitting illumination source comprises incandescent light bulb means.

4. An internally-lighted display apparatus in accordance with claim 2 in which said heat emitting illumination source comprises fluorescent lighting means.

5. An internally-lighted display apparatus in accordance with claim 3 in which said outermost sheet is a paper sheet.

6. An internally-lighted display apparatus in accordance with claim 5 in which said paper sheet bears a map design.

* * * * *